US009010075B2

(12) United States Patent
Bridges et al.

(10) Patent No.: US 9,010,075 B2
(45) Date of Patent: Apr. 21, 2015

(54) SYSTEMS AND METHODS FOR GAS PACKAGING

(75) Inventors: John Bridges, Pflugerville, TX (US); Oliver F. Campbell, Austin, TX (US)

(73) Assignee: Dell Products LP, Round Rock, TX (US)

( * ) Notice: Subject to any disclaimer, the term of this patent is extended or adjusted under 35 U.S.C. 154(b) by 1056 days.

(21) Appl. No.: 13/076,956

(22) Filed: Mar. 31, 2011

(65) Prior Publication Data

US 2012/0247071 A1 Oct. 4, 2012

(51) Int. Cl.

| | |
|---|---|
| ***B65D 81/05*** | (2006.01) |
| ***B65B 55/20*** | (2006.01) |
| ***B65B 23/00*** | (2006.01) |
| ***B31D 5/00*** | (2006.01) |

(52) U.S. Cl.

CPC ..... *B65D 81/052* (2013.01); *B31D 5/0073* (2013.01); *B65B 55/20* (2013.01); *B65B 23/00* (2013.01)

(58) Field of Classification Search

CPC ..... B31D 5/0073; B65B 23/00; B65B 55/20; B65D 81/052

USPC ..... 206/522, 593; 53/403, 445, 447, 472, 53/474, 492, 79, 139.5, 139.7

See application file for complete search history.

(56) References Cited

U.S. PATENT DOCUMENTS

| | | | | | |
|---|---|---|---|---|---|
| 2,994,425 | A | * | 8/1961 | Honeycutt | 53/445 |
| 3,366,231 | A | * | 1/1968 | Trakas | 206/522 |
| 4,017,351 | A | | 4/1977 | Larson et al. | |
| 4,096,306 | A | | 6/1978 | Larson | |
| 4,169,002 | A | | 9/1979 | Larson | |
| 4,427,474 | A | | 1/1984 | Ottaviano | |
| 4,492,147 | A | | 1/1985 | Knapp | |
| 4,564,407 | A | | 1/1986 | Tsuruta | |
| 4,576,669 | A | | 3/1986 | Caputo | |
| 4,579,516 | A | | 4/1986 | Caputo | |
| 4,779,359 | A | | 10/1988 | Famolare, Jr. | |
| 4,969,312 | A | * | 11/1990 | Pivert et al. | 53/472 |
| 5,060,801 | A | * | 10/1991 | Vilas-Boas | 206/523 |
| 5,145,069 | A | * | 9/1992 | Vilas Boas et al. | 206/497 |
| 5,180,060 | A | * | 1/1993 | Forti et al. | 206/522 |
| 5,340,632 | A | * | 8/1994 | Chappuis | 206/522 |
| 5,348,157 | A | * | 9/1994 | Pozzo | 206/522 |
| 5,445,274 | A | * | 8/1995 | Pharo | 206/522 |

(Continued)

FOREIGN PATENT DOCUMENTS

| | | | | | |
|---|---|---|---|---|---|
| DE | 2136164 | A1 | * | 1/1972 | B65D 81/052 |
| GB | 2291635 | A | * | 1/1996 | B65D 81/052 |

(Continued)

OTHER PUBLICATIONS

Fixeon, Air Cushion Packaging, Product Data Sheet, Jul. 2007, 2 pgs.

(Continued)

*Primary Examiner* — Stephen F Gerrity

(74) *Attorney, Agent, or Firm* — Egan, Peterman & Enders LLP.

(57) ABSTRACT

Multi-stage gas packaging systems and methods are provided that may be implemented in a first bulk packaging stage for bulk shipping of multiple items and then converted to a second single pack stage for single item shipment in an environment that is totally different from the bulk shipment environment.

25 Claims, 11 Drawing Sheets

(56) References Cited

U.S. PATENT DOCUMENTS

| | | | | | |
|---|---|---|---|---|---|
| 5,469,692 | A * | 11/1995 | Xanthopoulos | 53/474 |
| 5,469,966 | A * | 11/1995 | Boyer | 206/522 |
| 5,628,402 | A * | 5/1997 | Dickie et al. | 206/522 |
| 5,769,231 | A * | 6/1998 | Batsford | 206/522 |
| 5,815,950 | A | 10/1998 | Wang | |
| 5,862,914 | A * | 1/1999 | Farison et al. | 206/522 |
| 5,912,058 | A * | 6/1999 | Takahashi et al. | 206/522 |
| 5,974,694 | A | 11/1999 | Vecchiola | |
| 5,996,798 | A * | 12/1999 | Gessert | 206/522 |
| 6,079,056 | A | 6/2000 | Fogelberg | |
| 6,131,376 | A * | 10/2000 | Grey et al. | 53/472 |
| 6,212,719 | B1 | 4/2001 | Thomas et al. | |
| 6,230,333 | B1 | 5/2001 | Umeda | |
| 6,520,332 | B1 * | 2/2003 | Barmore et al. | 206/522 |
| 6,557,325 | B1 * | 5/2003 | Katz | 53/472 |
| 6,617,001 | B1 | 9/2003 | Arnold | |
| 7,040,073 | B2 | 5/2006 | Perkins et al. | |
| 7,185,474 | B2 | 3/2007 | Perkins et al. | |
| 7,228,969 | B2 | 6/2007 | Nakano | |
| 7,297,387 | B2 | 11/2007 | Koyanagi | |
| 7,377,393 | B2 * | 5/2008 | Maresh et al. | 206/522 |
| 7,523,565 | B1 | 4/2009 | Chen | |
| D592,390 | S | 5/2009 | Feldman et al. | |
| 7,533,772 | B2 * | 5/2009 | Yoshifusa et al. | 206/522 |
| 7,584,848 | B2 * | 9/2009 | Yoshifusa | 206/522 |
| 7,770,731 | B2 | 8/2010 | Jian | |
| 2002/0185403 | A1 * | 12/2002 | Russo | 206/522 |
| 2004/0149618 | A1 * | 8/2004 | Otaki et al. | 206/521 |
| 2004/0163991 | A1 * | 8/2004 | Koyanagi et al. | 206/521 |
| 2005/0006271 | A1 * | 1/2005 | Nakagawa | 206/521 |
| 2005/0263425 | A1 * | 12/2005 | Tanaka et al. | 206/522 |
| 2006/0090421 | A1 * | 5/2006 | Sperry et al. | 53/403 |
| 2006/0191817 | A1 * | 8/2006 | Nishi et al. | 206/522 |
| 2007/0034548 | A1 | 2/2007 | De Nola | |
| 2007/0051655 | A1 * | 3/2007 | Yoshifusa | 206/522 |
| 2007/0065047 | A1 * | 3/2007 | Kojima et al. | 206/522 |
| 2007/0084745 | A1 * | 4/2007 | Yoshifusa | 206/522 |
| 2007/0131575 | A1 * | 6/2007 | Abe | 206/522 |
| 2007/0246394 | A1 * | 10/2007 | Yoshifusa | 206/522 |
| 2007/0264473 | A1 * | 11/2007 | Liao | 428/166 |
| 2008/0073238 | A1 * | 3/2008 | Liao et al. | 206/522 |
| 2008/0159659 | A1 * | 7/2008 | Liao et al. | 206/522 |
| 2008/0197041 | A1 * | 8/2008 | Jian | 206/522 |
| 2009/0007525 | A1 * | 1/2009 | Lewis et al. | 53/474 |
| 2009/0050509 | A1 * | 2/2009 | Liao et al. | 206/522 |
| 2009/0188830 | A1 * | 7/2009 | Liao et al. | 206/522 |
| 2010/0101661 | A1 * | 4/2010 | Hamm et al. | 137/223 |
| 2010/0147712 | A1 * | 6/2010 | Filho et al. | 206/522 |
| 2011/0010313 | A1 | 1/2011 | Ozias et al. | |

FOREIGN PATENT DOCUMENTS

| | | | | |
|---|---|---|---|---|
| JP | 04327158 | A * | 11/1992 | 206/522 |
| WO | WO 02083521 | A1 * | 10/2002 | B65D 81/052 |

OTHER PUBLICATIONS

Inflatable Packaging, Inc, Where Air Meets Technology, Printed From Internet Jan. 11, 2011, 1 pg.
Fill-Air, Sealed Air, Printed From Internet Jan. 11, 2011, 1 pg.
GL Packaging Products, Dunnage Air Bags, Printed From Internet Jan. 11, 2011, 2 pgs.
Bubbla, Air Inflatable Packaging Systems, Printed From Internet Jan. 11, 2011, 2 pgs.

* cited by examiner 190
106
190
106
190
106

700
700
700
700
700
102
110
510
102
110
106
120
104
510
110
102
106
102
110
510
110
106
120
104
106
120
104
110
106
120
104
510
106
120
104
110
106
120
104
510
106
120
104
110
106
120
104
510

SYSTEMS AND METHODS FOR GAS PACKAGING

FIELD OF THE INVENTION

This invention relates generally to packaging and, more particularly, to systems and methods for gas packaging.

BACKGROUND OF THE INVENTION

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Packing materials are employed for cushioning and protecting items such as information handling systems that are shipped from one location to another within outer shipping cartons. Examples of conventional packing materials include styrofoam packing peanuts, bubble wrap, inflatable air pillows, etc. Such materials are typically placed to surround an item that is shipped within an outer carton. Molded foam or cardboard packing cushions are also employed to suspend a shipped item between two such cushions within the interior of an outer shipping carton. For example, an information handling system such as a notebook computer may be supported and cushioned within a corrugated shipping box between a set of two packing cushions or "buns" (foam pads) that each include an internal opening for receiving and supporting one end of the notebook computer.

Multiple items may be shipped together within a single container in a bulk pack configuration. Bulk packs are often used to ship items from a manufacturer to a distributer. For example, multiple information handling systems may be shipped in a single bulk container from a manufacturer or assembler to a corporate customer information technology (IT) facility. The distributer may separate the multiple items and then repackage each of them for individual item shipment in a single pack carton to an end use customer or client.

SUMMARY OF THE INVENTION

Disclosed herein are multi-stage gas packaging systems and methods that are convertible to meet different shipping environments with little to no additional cost over conventional systems, and that may be implemented to package and ship items such as information handling systems (e.g., notebook computers, etc.) using environmentally green gas packaging technology. In one example, the disclosed systems and methods may be advantageously implemented in a first stage to provide inbound gas packaging material (e.g., as an inbound bulk pack containing multiple shipping items) that may be converted to a second stage for use for outbound shipments in a single item shipment distribution environment that is totally different from the inbound bulk shipment environment. This conversion may be achieved without requiring the first stage bulk packaging configuration to employ more cushioning than is required for the multi-item bulk shipment environment, while at the same time providing adequate cushioning in the second stage for shipping individual items.

In one embodiment, a multi-stage gas pack may be deployed in a first stage bulk packaging configuration that allows multiple items (e.g., multiple notebook computers) to be shipped together in a bulk configuration from a first physical location to a second and different physical location (e.g., shipped between a factory and a distribution point, between first and second rooms in a given office, between first and second offices in a given city, between first and second cities, between first and second states or countries, etc.). Following the bulk shipment of the multiple information handling systems, the multi-stage gas pack may be converted to a second stage single pack configuration of multiple single pack shipping units for further shipment of the individual information handling systems separately to end users at third and different physical locations. Besides notebook computers, the disclosed systems and methods may be implemented for gas packaging of other types of portable information handling systems and information handling systems (e.g., desktop computers, servers, computerized instruments, etc.) having varying form factors. Other types of items (e.g., electrical appliances, toys, smaller boxes containing other items, etc.) may also be gas packaged for shipping using the disclosed systems and methods.

In one exemplary embodiment, the disclosed gas packaging systems and methods may be first employed for bulk shipment of multiple information handling systems in a first stage bulk pack from an origin location (e.g., factory or assembly facility) to a first intermediate destination (e.g., to an information handling system distributer, or to a corporate customer IT facility where the information handling systems may be unpacked and the system software optionally re-imaged), and then converted to a second stage at little or no cost for single pack shipping of the individual information handling systems to a second destination, e.g., to respective individual customers or end users. Thus, in one embodiment, close to zero waste packaging may be achieved by employing the same gas packaging material in a first stage for bulk pack shipping of multiple information handling systems together from an origin destination to an intermediate destination, and in a second stage for single pack shipping of individual re-imaged information handling systems from the intermediate destination to each system's final destination or end user. This capability may be further employed to save space and resources at an intermediate destination (e.g., distributor warehouse, corporate customer IT facilities, etc.) by reducing incoming pack volume and storage requirements, while allowing for single unit shipping out from the intermediate destination.

In one respect, disclosed herein is a method for shipping an item, including: providing multiple items to be shipped, each of the multiple items having opposing first and second ends; providing a bulk shipping container; providing a first multi-stage gas packaging system including multiple shipping units coupled together by separable links in a first stage bulk packaging configuration, and each of the multiple shipping units including multiple gas inflatable cushions that define an item cavity therebetween that is configured with a shape and dimension complementary to the outer dimensions of the first end of an item to be shipped; providing a second multi-stage gas packaging system including multiple shipping units coupled together by separable links in a first stage bulk packaging configuration, and each of the multiple shipping units including multiple gas inflatable cushions that define an item cavity therebetween that is configured with a shape and dimension complementary to the outer dimensions of the first end of an item to be shipped; and positioning the shipped items and the first and second multi-stage gas packaging systems in relation to each other within the bulk shipping container such that each item cavity of the first multi-stage gas packaging system faces a corresponding item cavity of the second multi-stage gas packaging system with a first end of each shipped item disposed in an item cavity of the first multi-stage gas packaging system and with the opposing second end of each shipped item disposed in a corresponding item cavity of the second multi-stage gas packaging system.

In another respect, disclosed herein is a multi-stage gas packaging system convertible between a first stage bulk packaging configuration and a second stage single pack configuration. The multi-stage gas packaging system may include multiple shipping units coupled together by separable links in a first stage bulk packaging configuration, with each of the multiple shipping units including multiple gas inflatable cushions that define an item cavity therebetween that is configured with a shape and dimension complementary to the outer dimensions of the first end of an item to be shipped. The multi-stage gas packaging system may also be configured for conversion to a second stage single pack configuration by separating each of the shipping units from each other at the separable links therebetween to form individual single pack shipping units.

In another respect, disclosed herein is a method for shipping an item, including: providing multiple items to be shipped, each of the multiple items having opposing first and second ends; providing a bulk shipping container; providing a first multi-stage gas packaging system in a first stage bulk packaging configuration and providing a second multi-stage gas packaging system in a first stage bulk packaging configuration.

The first multi-stage gas packaging system of the method of the preceding paragraph may include: multiple gas inflatable center cushions positioned adjacent to each other between opposing ends of the first multi-stage packaging system and a gas inflatable intermediate or terminal side cushion connected to each of two opposing sides of each of the multiple gas inflatable center cushions of the first multi-stage packaging system, where a gas inflatable intermediate side cushion connected to each gas inflatable center gas cushion is also connected by a separable link to another gas inflatable intermediate side cushion connected to an adjacent gas inflatable center gas cushion to hold the multiple gas inflatable center cushions of the first multi-stage packaging system in adjacent position to each other, where a terminal gas inflatable side cushion not connected to another gas inflatable side cushion is connected to the gas inflatable center gas cushions present at each of the opposing ends of the first multi-stage packaging system, and where an item cavity configured with a shape and dimension complementary to the outer dimensions of the first end of an item to be shipped is defined between each given gas inflatable center cushion and the two gas inflatable side cushions connected to the given gas inflatable center cushion of the first multi-stage packaging system.

The second multi-stage gas packaging system of the method of the preceding two paragraphs may include: multiple gas inflatable center cushions positioned adjacent to each other between opposing ends of the second multi-stage packaging system, and a gas inflatable intermediate or terminal side cushion connected to each of two opposing sides of each of the multiple gas inflatable center cushions of the second multi-stage packaging system, where a gas inflatable intermediate side cushion connected to each gas inflatable center gas cushion is also connected by a separable link to another gas inflatable intermediate side cushion connected to an adjacent gas inflatable center gas cushion to hold the multiple gas inflatable center cushions of the second multi-stage packaging system in adjacent position to each other, where a terminal gas inflatable side cushion not connected to another gas inflatable side cushion is connected to the gas inflatable center gas cushions present at each of the opposing ends of the second multi-stage packaging system, and where an item cavity configured with a shape and dimension complementary to the outer dimensions of the second end of an item to be shipped is defined between each given gas inflatable center cushion and the two gas inflatable side cushions connected to the given gas inflatable center cushion of the second multi-stage packaging system.

The method described in the preceding three paragraphs may also include: providing each of the gas inflatable terminal side cushions and each of the gas inflatable center cushions of the first and second multi-stage gas packaging systems in a more fully inflated higher gas pressure state than each of the gas inflatable side cushions of the first and second multi-stage gas packaging systems; and positioning the shipped items and the first and second multi-stage gas packaging systems in relation to each other within the bulk shipping container such that each item cavity of the first multi-stage gas packaging system faces a corresponding item cavity of the second multi-stage gas packaging system with a first end of each shipped item disposed in an item cavity of the first multi-stage gas packaging system and with the opposing second end of each shipped item disposed in a corresponding item cavity of the second multi-stage gas packaging system.

In another respect, disclosed herein is a multi-stage gas packaging system convertible between a first stage bulk packaging configuration and a second stage single pack configuration, including: multiple gas inflatable center cushions positioned adjacent to each other between opposing ends of the multi-stage packaging system; and a gas inflatable intermediate or terminal side cushion connected to each of two opposing sides of each of the multiple gas inflatable center cushions of the multi-stage packaging system. In the first stage bulk packaging configuration, the multi-stage gas packaging system may have the following characteristics: the multiple gas inflatable center cushions are positioned adjacent to each other between opposing ends of the multi-stage packaging system, a gas inflatable intermediate side cushion connected to each gas inflatable center gas cushion is also connected by a separable link to another gas inflatable intermediate side cushion connected to an adjacent gas inflatable center gas cushion to hold the multiple gas inflatable center cushions of the multi-stage packaging system in adjacent position to each other, a terminal gas inflatable side cushion not connected to another gas inflatable side cushion is connected to the gas inflatable center gas cushions present at each of the opposing ends of the multi-stage packaging system, and an item cavity configured with a shape and dimension complementary to the outer dimensions of one end of an item to be shipped is defined between each given gas inflatable center cushion and the two gas inflatable side cushions connected to the given gas inflatable center cushion of the multi-stage packaging system. The multi-stage gas packaging system may be configured for conversion to a second stage single pack configuration by separating each of the intermediate side cushions from another of the intermediate side cushions at the separable link therebetween to form a single pack shipping unit including a gas inflatable center cushion coupled between two gas inflatable side cushions with an item cavity defined therebetween that has a shape and dimension complementary to the outer dimensions of one end of an item to be shipped.

DESCRIPTION OF ILLUSTRATIVE EMBODIMENTS

Figure 1A:
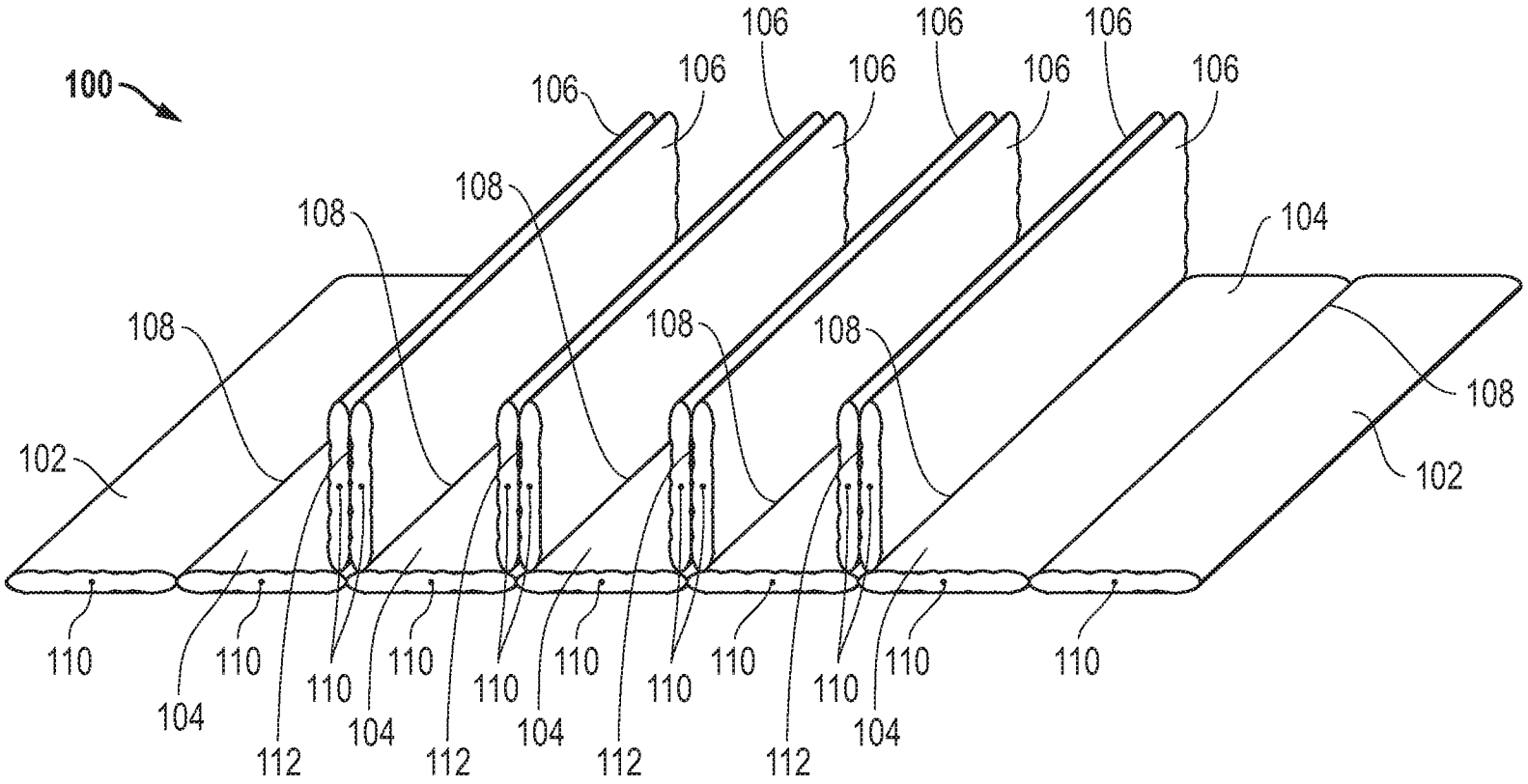
FIG. 1A illustrates a convertible multi-stage gas packaging system according to one exemplary embodiment of the disclosed systems and methods.

FIG. 1A illustrates an exemplary embodiment of a convertible multi-stage gas packaging system 100 in deflated state, e.g., such as after manufacture but prior to use. System 100 includes multiple interconnected gas cushions 102, 104 and 106 that are each individually inflatable with a suitable gas (e.g., air, nitrogen, $CO_2$, etc.) through a respective gas valve 110. In the illustrated embodiment, each of cushions 102, 104 and 106 are similarly dimensioned, although this is not necessary. Each of cushions 102, 104 and 106 includes four edges having a variable dimension corresponding at any given time to the inflated thickness of the cushion, and two opposing flat side surfaces peripherally defined by the length and width dimensions of the individual cushion, i.e., such that the two cushion sides have a greater surface area than any given one of the four edges of the same cushion. It will be understood that the particular illustrated shape of cushions 102, 104 and 106 is exemplary only, and that other shapes and or combination of shapes maybe employed to fit a given application, e.g., each of cushions 106 and 102 may be of a different shape and/or dimension than cushions 104.

Referring in more detail to FIG. 1A, system 100 includes multiple center cushions 104 that are each hingeably coupled on one edge to an adjacent intermediate side cushion 106 by a respective seam 108, and that are each hingeably coupled on the other opposing edge to another adjacent side cushion 102 or 106 by a respective seam 108 to form a three-cushion shipping unit, it being understood that more than three gas inflatable cushions may be provided for a given shipping unit. Together, each center cushion 104 and its hingeably-coupled side cushions 102/106 form an individual shipping unit 101 that defines a cavity 190 therein as will be described further in relation to FIG. 1B. It will be understood that although shipping units 101 are each illustrated as having three cushions in this embodiment, a shipping unit 101 may include more than three cushions in other embodiments.

System 100 includes a total of two terminal (end) side gas cushions 102 present at each opposing end of system 100 that is only hingeably coupled on one edge to a center cushion 104 and that is not connected by a separable link to any other side cushion. In the illustrated embodiment, system 100 includes a total of five center cushions 104 forming a total of five corresponding shipping units, although a given system 100 may include any other given number of two or more center cushions 104. In this regard, the particular number of center cushions 104 and corresponding shipping units provided for a given system 100 corresponds to the number of items (e.g., information handling systems) that may be bulk packaged for shipment together in a manner that will be described further herein.

In the embodiment of FIG. 1A, the entire system 100 is manufactured at the same time of the same material by a heat seal manufacturing process. Examples of materials that may be employed for system 100 include any suitable gas packaging material, e.g., such as low-density polyethylene "LDPE", Nylon, etc. Such materials may be configured such that sidewalls of each cushion may have a thickness suitable for the given item and/or shipping environment for a given application. For example, in one embodiment for shipping information handling systems such as notebook computers, each of cushions 102, 104 and 106 may be manufactured of LDPE material having a wall thickness of about 4.5 mil (115 micrometers). Gas valve 100 of each cushion 102, 104 and 106 may be any integral gas valve feature (e.g., such as nylon gas valve, nylon/LDPE blend gas valve, etc.) through which gas may be introduced at any given time to inflate the respective cushion during the operational life of the system 100, and which operates as a check valve to retain the gas within the cushion after inflation. Examples of suitable valve types include reverse air valves, etc. Gas packaging cushions and associated equipment are available from a variety of manufacturers including, but not limited to, Inflatable Packaging, Inc. of Newtown, Conn. (under trade names such as En-Cap, LucidAir, Waffle-Pak, Airworks, Air Lock, Airbag, Air space), Unitedtape.com (under trade names such as Air Space) and Sealed Air of Elmwood Park, N.J. (under trade names such as Fill Teck and Fill-Air).

Figure 1B:
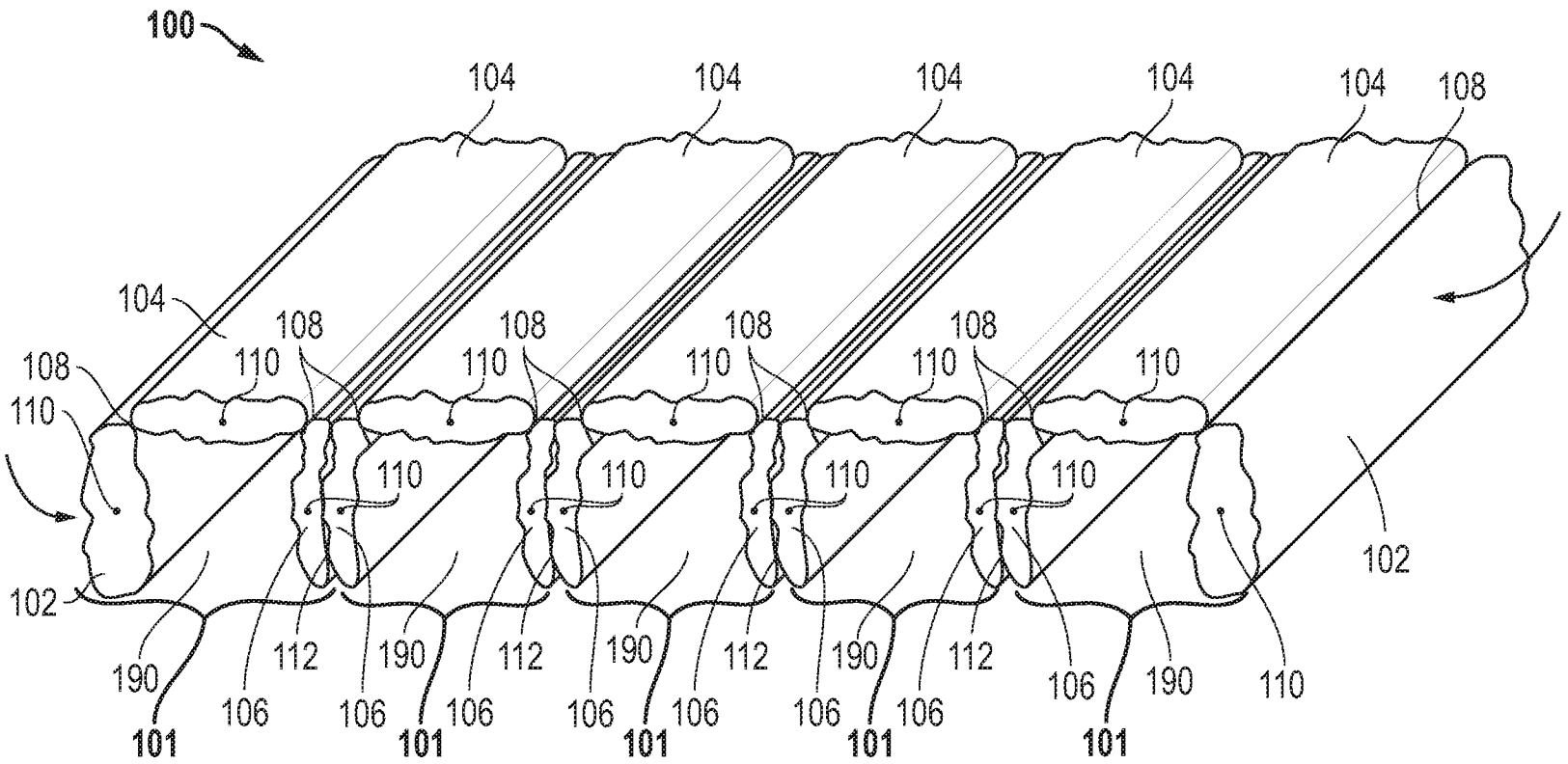
FIG. 1B illustrates a convertible multi-stage gas packaging system according to one exemplary embodiment of the disclosed systems and methods.
Figure 2:
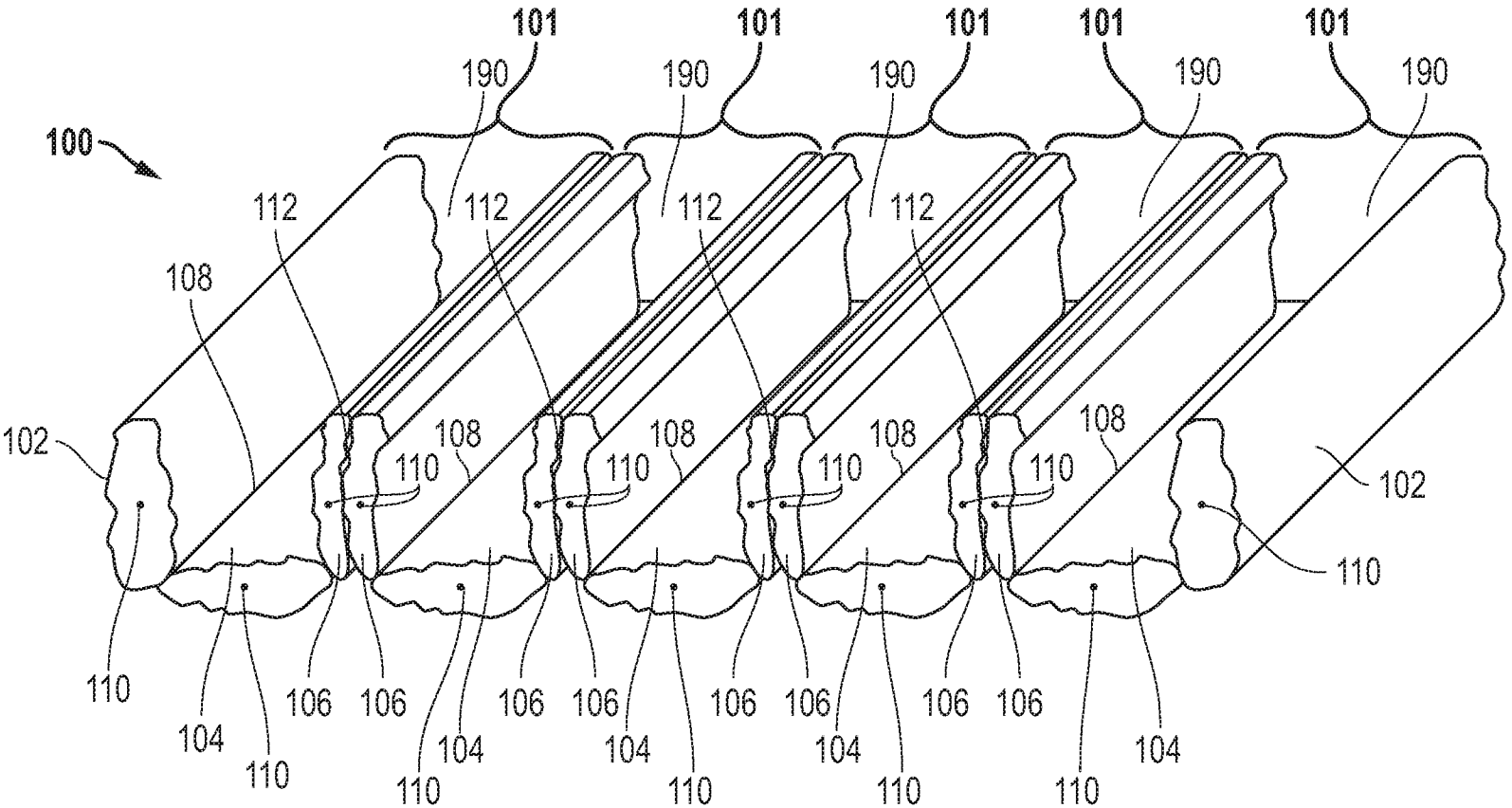
FIG. 2 illustrates a convertible multi-stage gas packaging system according to one exemplary embodiment of the disclosed systems and methods.

As shown in FIG. 1A, each of intermediate side cushions 106 is coupled on one side along at least a portion of its length to the side of another adjoining adjacent intermediate side cushion 106 by a separable link 112 (e.g., perforated material). FIGS. 1B and 2 each show convertible multi-stage gas packaging system 100 in a first stage bulk packaging configuration with the internal volume of each of side cushions 102/106 and center cushions 104 substantially fully inflated (e.g., to an internal air pressure of about 10 psi) and with the internal volume of each of intermediate side cushions 106 only partially inflated (e.g., to an internal air pressure of about 5 psi). These pressures are only exemplary, and it will be understood that in this embodiment any other relative amount of inflation levels may be employed such that each of the bottom and outer perimeter cushions 106 and 104 are inflated to a higher gas pressure than interior cushions 106 for bulk packaging configuration.

As shown in FIGS. 1B and 2, an item cavity 190 is defined between the side surfaces of each pair of spaced-apart adjacent intermediate side cushions 106 and the center cushion 104 that lies therebetween. Similarly, an item cavity 190 is defined on each of the opposing ends of packaging system 100 between each terminal side cushion 102, a spaced-apart adjacent intermediate side cushion 106, and the center cushion 104 that lies therebetween. As will be described further herein, each item cavity 190 is configured with a shape and dimension complementary to the outer dimensions to one end of an item to be shipped using convertible multi-stage gas packaging system 100. Since each intermediate side cushion 106 is coupled to the side of another adjoining adjacent intermediate side cushion 106, a unified packaging system 100 is configured that has five individual item cavities 190 that are properly spaced for alignment with item cavities 190 of another gas packaging system 100 to receive five items therebetween for shipment together in a bulk packaged shipment.

Figure 3:
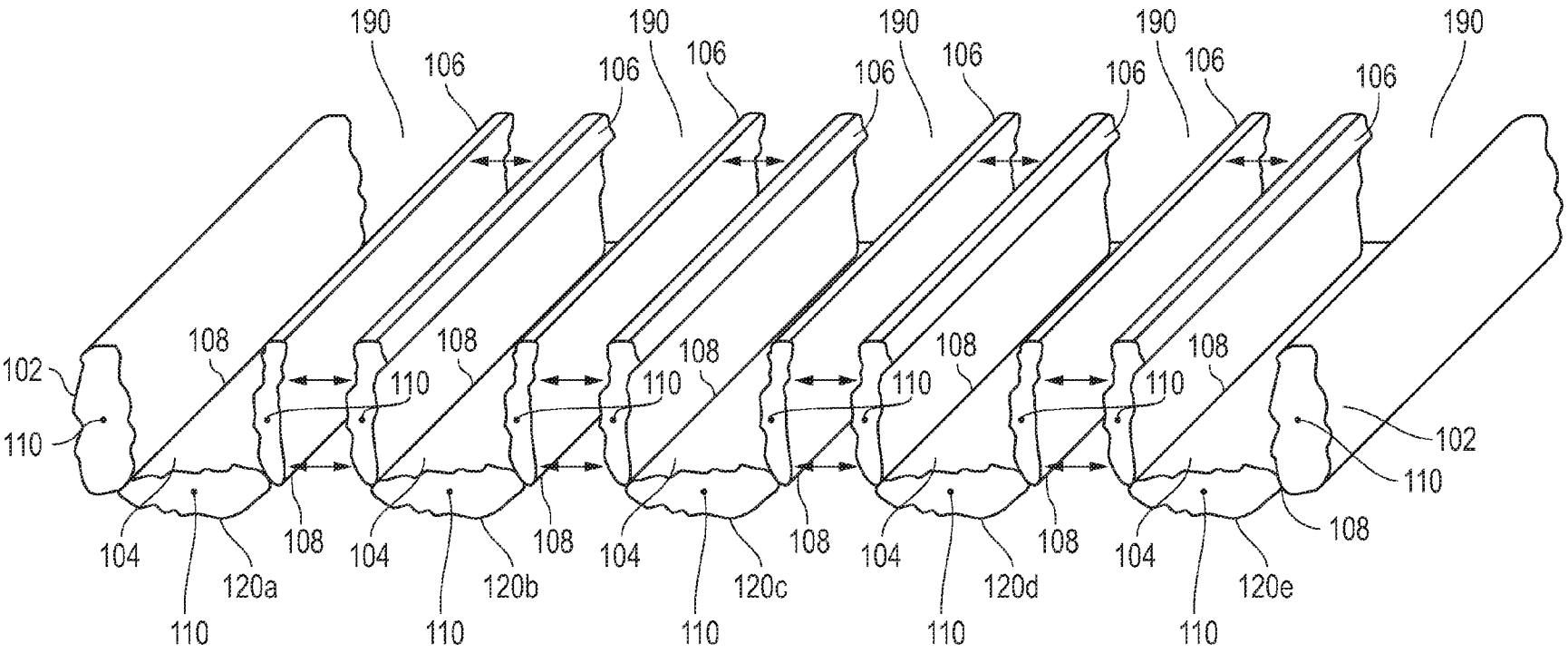
FIG. 3 illustrates separation of shipping units of a convertible multi-stage gas packaging system according to one exemplary embodiment of the disclosed systems and methods.
Figure 4:
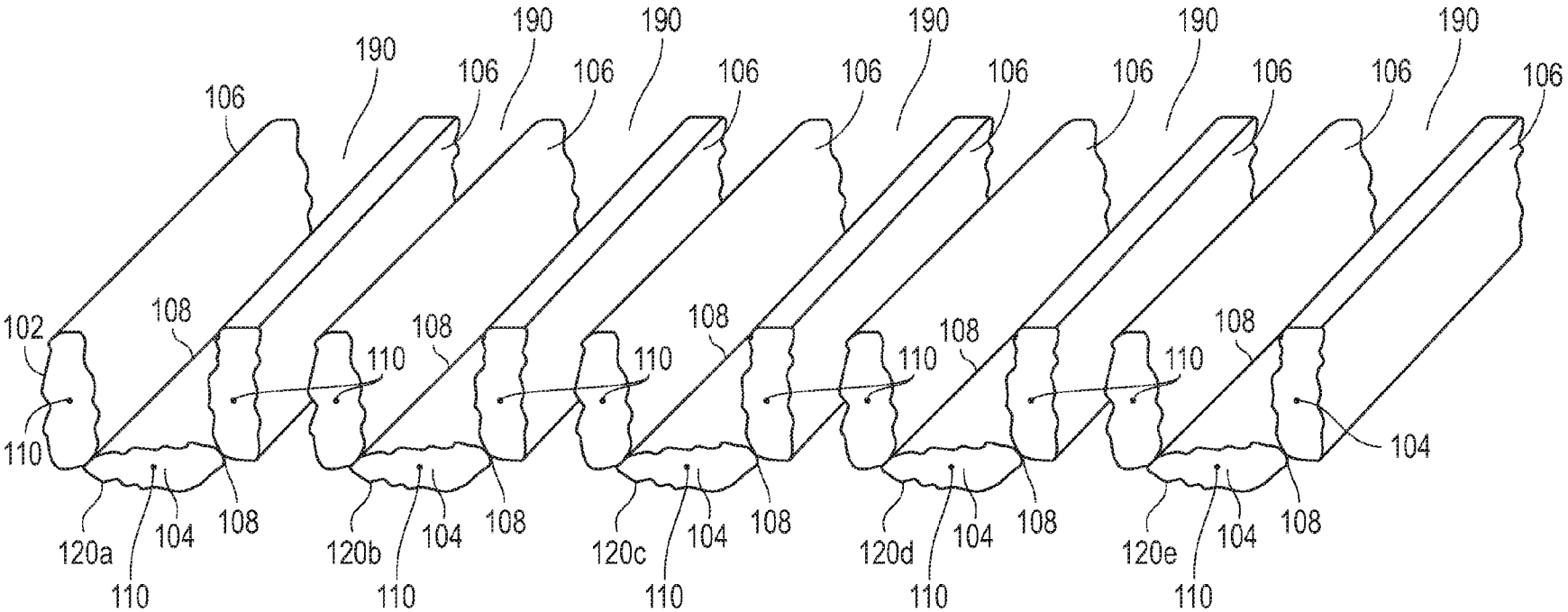
FIG. 4 illustrates multiple single pack shipping units according to one exemplary embodiment of the disclosed systems and methods.

FIG. 3 shows convertible multi-stage gas packaging system 100 with each intermediate side cushion 106 separated at the separable link 112 of perforated material from its previously-adjoining adjacent intermediate side cushion 106 (e.g., by manually pulling the cushions 106 in the direction of the arrows) to separate single shipping units in preparation for conversion to a second stage single pack configuration. In one exemplary embodiment, separable link 112 may be, for example, ⅛"×⅛" perforations with solid heat seals on both sides, although any other suitable separable link configuration may be employed. FIG. 4 shows single pack shipping units 120*a*-120*e* with all separated intermediate side cushions 106 inflated substantially fully inflated (e.g., to an internal air pressure of about 10 psi) or to any other suitable pressure for outbound single pack shipment environments to convert convertible multi-stage gas packaging system 100 to a second stage single pack configuration of separated multiple single pack shipping units 120. In this regard, the outer perimeter cushions 106 are further inflated for single shipment usage because the handling is different for the inbound bulk container as it would be for a single unit shipment. Although not necessary, all cells or cushions of each single pack shipping unit 120 may be inflated to substantially the same pressure for ease of proper inflation.

Figure 5:
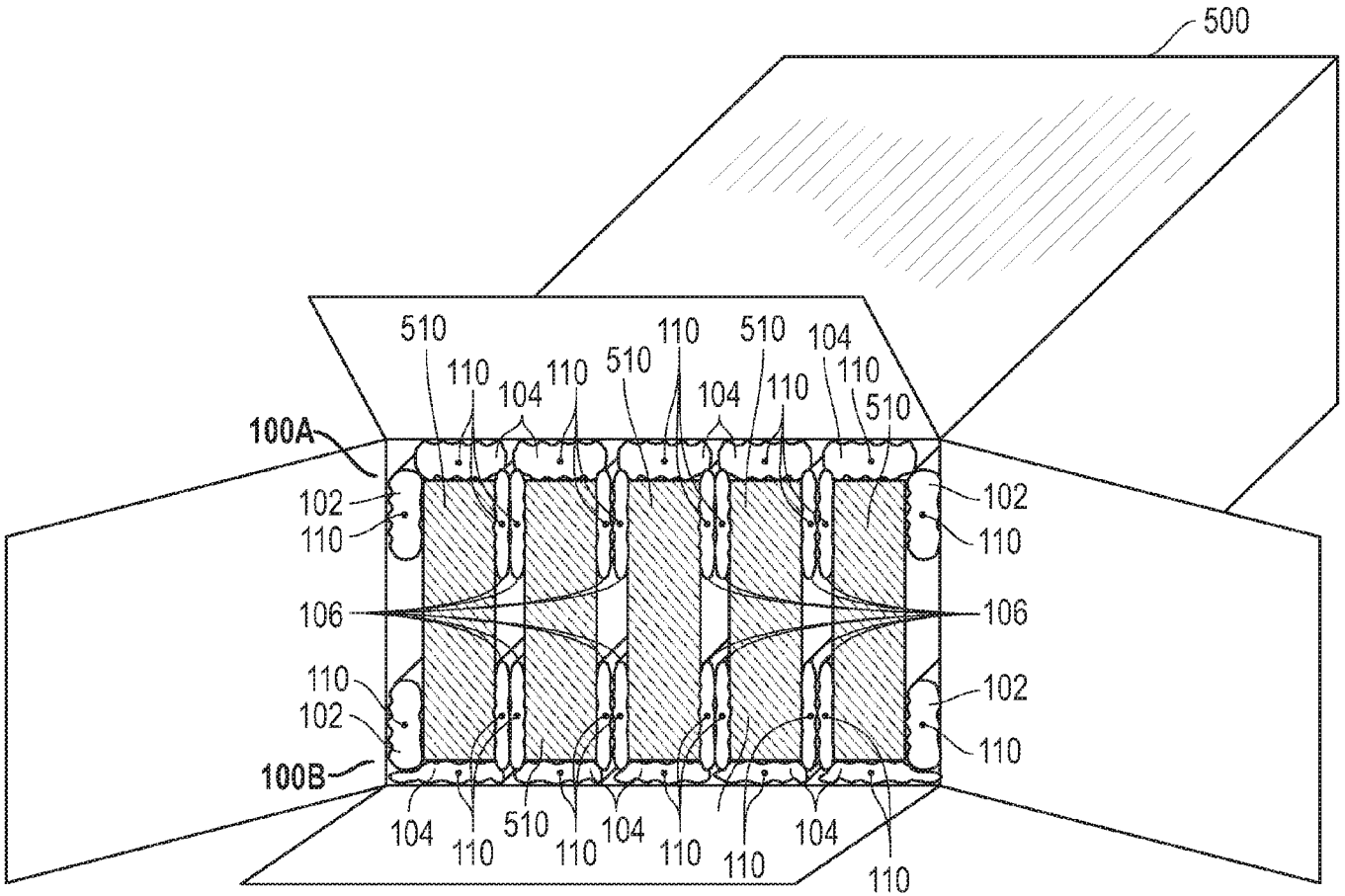
FIG. 5 illustrates two convertible multi-stage gas packaging systems deployed in a first stage bulk packaging configuration within a bulk shipping container according to one exemplary embodiment of the disclosed systems and methods.

FIG. 5 illustrates shows two convertible multi-stage gas packaging systems 100A and 100B that each deployed in a first stage bulk packaging configuration within a bulk shipping container 500 (e.g., corrugated cardboard shipping carton) as illustrated and described above in relation to FIGS. 1B and 2. In FIG. 5, systems 100A and 100B are oriented such that respective pairs of item cavities 190 of systems 100A and 100B are arranged to face each other so that each item cavity 190 of a pair of item cavities 190 receives one of the opposing ends of a respective item to be shipped, in this case an information handling system 510 such as a notebook computer. In the first stage bulk packaging configuration, the item cavities 190 of each respective system 100A and 100B are properly spaced such that systems 100A and 100B may be brought together about opposing ends of five separate shipped items such that a first end of each shipped item is received in a cavity 190 of system 100A and a opposing end of the same shipped item is received in an opposing item cavity 190 of system 100B. Alternately, five shipped items 510 may be provided between respective item cavities 190 of systems 100A and 100B in other suitable alternative method, e.g., by first placing the first end of each of five shipped items 510 into the respective item cavities 190 of system 100A, and then aligning and placing system 100B in engagement with the free opposing second ends of shipped items 510 such that each of the opposing second ends are received in a an opposing item cavity 190 of system 100B.

As shown in FIG. 5, substantially fully inflated intermediate side cushions 106 and center cushions 104 (e.g., each inflated in one exemplary embodiment to a fully-inflated thickness of about 2 inches or about 51 mm) act to create an gas cushioned space between shipped items 510 and the inner sidewalls of shipping container 500, and each pair of joined partially inflated intermediate side cushions 106 (e.g., each inflated in one exemplary embodiment to a partially inflated thickness of about 1 inch or about 25 mm) creates a gas cushioned space between the sides of adjacent shipped items 510. In the illustration of FIG. 5, the bottom row of center cushions 104 are shown partially compressed by the weight of shipped items 510 since container 500 is lying on its side. Because joined intermediate side cushions 106 are only partially inflated in this bulk packaging configuration, additional space is created within shipping container 500 for shipped items 510. However, since two joined side cushions 106 are present between the sides of adjacent shipped items 510, the gas cushioned space created between adjacent items 510 within shipping container 500 is approximately twice the width of each partially inflated individual cushion 106 to give adequate cushioning for shipment. Moreover, in one palletized bulk pack shipping embodiment, the cells of cushions 106 positioned in-between shipped items 510 in first stage bulk packaging configuration may be at a reduced pressure relative to pressure employed for single pack shipping since the amount of physical handling of an inbound palletized bulk pack is relatively minimal as compared to the amount of physical handling employed for single pack shipping.

Figure 6:
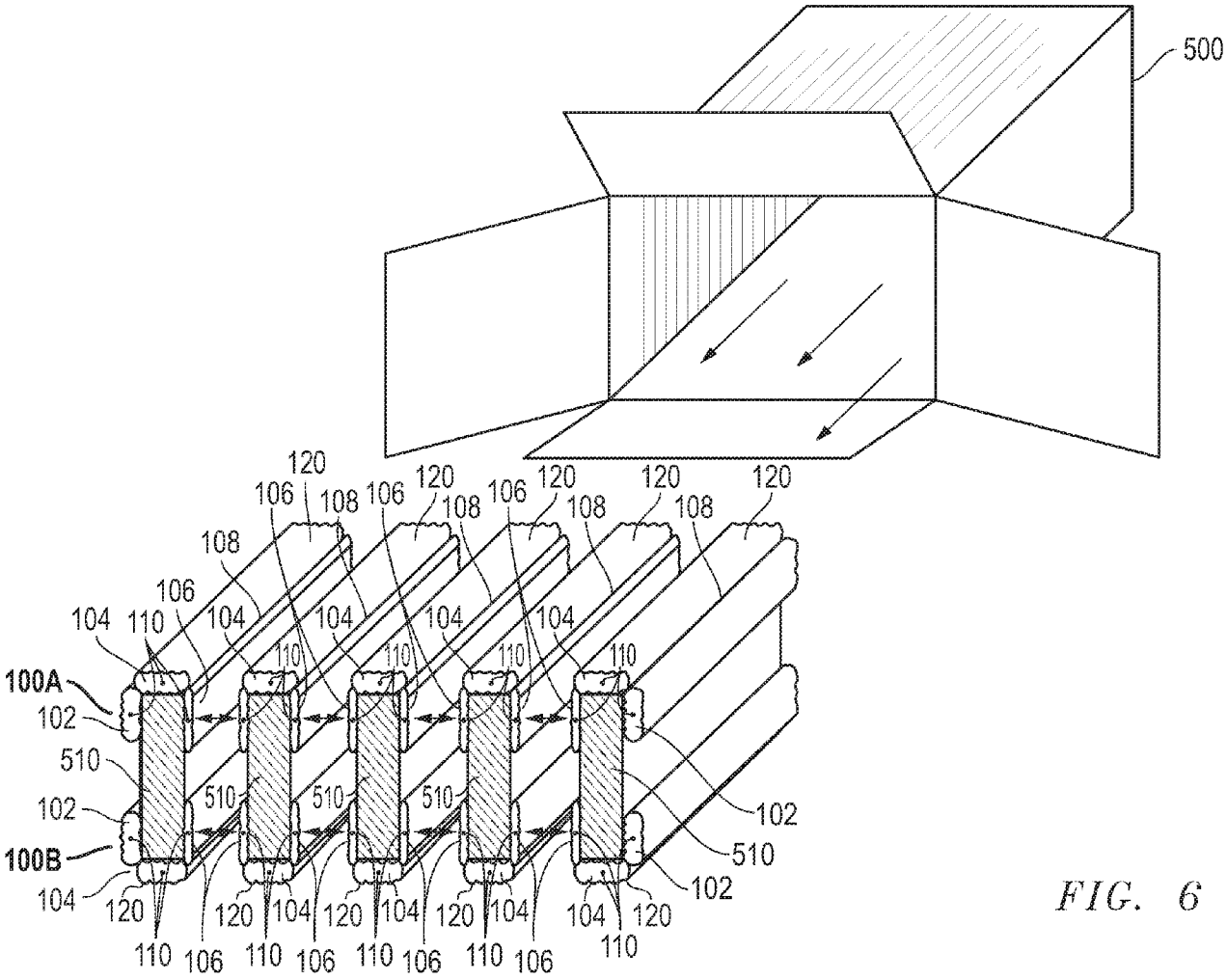
FIG. 6 illustrates removal of convertible multi-stage gas packaging systems from a bulk shipping container and separation of the shipping units of the multi-stage gas packaging systems according to one exemplary embodiment of the disclosed systems and methods.

Arrows in FIG. 6 illustrate removal of bulk packaged shipped items 510 and convertible multi-stage gas packaging systems 100A and 100B from bulk shipping container 500, e.g., after insertion of items 510 into container 500 and bulk shipment of bulk packaged items 510 within bulk shipping container 500 from a first bulk supply physical location (e.g., such as a factory or assembly plant for items 510) to an intermediate physical location (e.g., such as a distribution point for items 510) where the removal of items 510 from container 500 occurs. As shown, adjacent cushions 106 may be separated from each other (e.g., by manually or mechanically pulling items 510 apart from each other) without removing items 510 from item cavities 190 of systems 100A and 100B, although separation may be performed in any other suitable manner, e.g., by removing items 510 from item cavities 190 and then separating adjacent cushions 190 prior to re-inserting opposing ends of each item 510 into a respective item cavity 190 of a separated system 100. In any event, each of the opposing ends of each individual shipped item 510 are received in an item cavity 190 of a separated system 100A or 100B. Adjacent cushions 106 of systems 100A and 100B may be so separated from each other to provide individual three-cushion single pack shipping units 120 as shown, it being understood that the number of cushions or cells that may be employed for a given single pack shipping unit may be other then three, e.g., four or more cushions.

Figure 7:
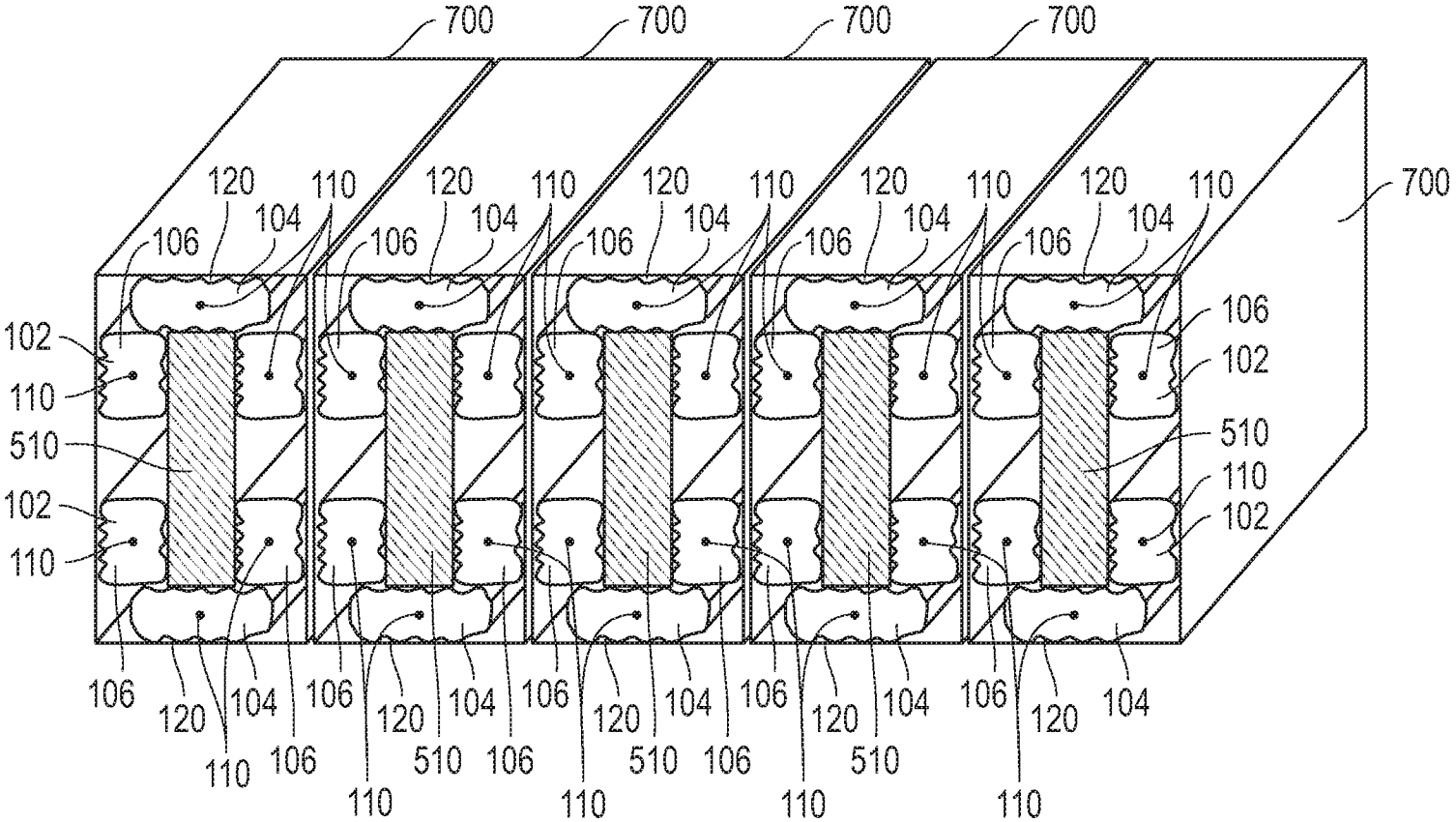
FIG. 7 illustrates multiple separated single pack shipping units and single pack shipping containers according to one exemplary embodiment of the disclosed systems and methods.

FIG. 7 illustrates separated gas packaging systems 100A and 100B in which previously under-inflated side cushions 106 of each single pack shipping unit 120 have been substantially fully inflated in this exemplary embodiment to fully convert each of single pack shipping units 120 to a second stage single pack configuration. In FIG. 7, each of the opposing ends of a shipped item 510 is received within an item cavity 190 of a separated gas packaging system 100 such that the shipped item 510 is disposed therebetween.

Figure 8:
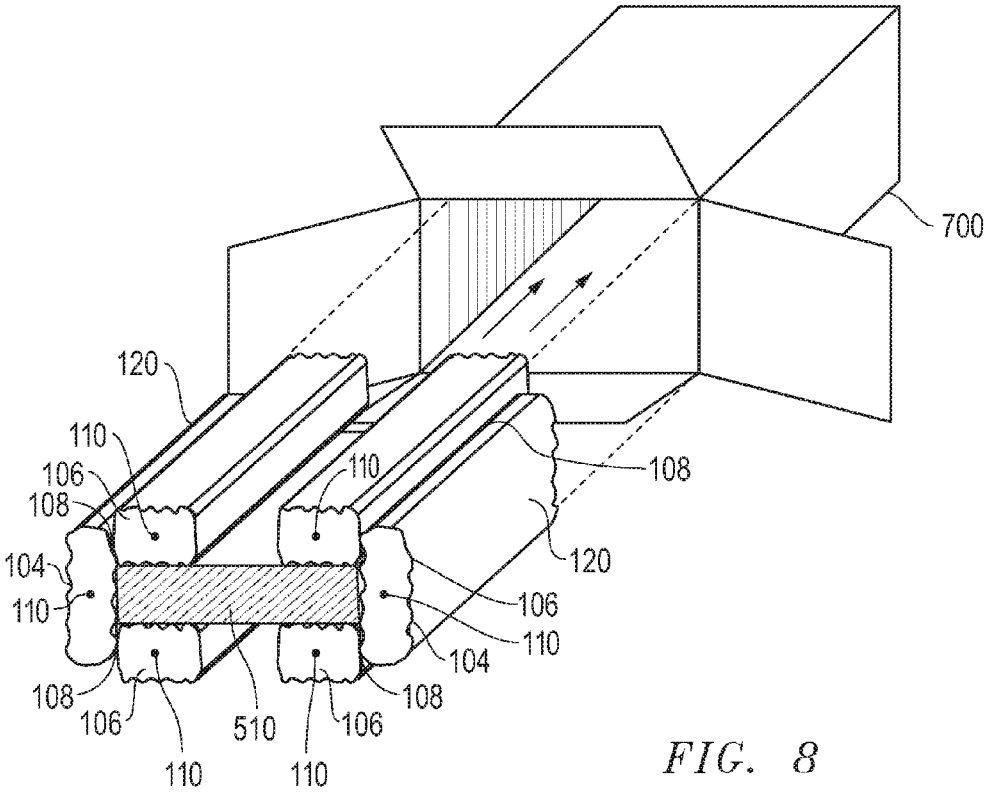
FIG. 8 illustrates insertion of single pack shipping units into the interior of a single pack shipping container according to one exemplary embodiment of the disclosed systems and methods.

In FIG. 8, the assembly of each shipped item 510 of FIG. 8 with its two surrounding single pack shipping units 120 is shown being inserted in the direction of the arrows into the interior of a single pack shipping container 700 (e.g., corrugated cardboard container) that is internally dimensioned to receive the individual shipped item 510 in suspended position between its two surrounding single pack shipping units 120 for further single item shipment of the individual information handling systems, e.g., from an intermediate physical location (e.g., such as a distribution point for items 510) to a destination location (e.g., such as an end user's address or a retail sales facility). In this way, one or more of each of shipped items 510 of FIGS. 7 and 8 may be single pack shipped (e.g., such as by hand drop shipping) to a different destination location than one or more of the other shipped items 510 of FIG. 7. As shown in the embodiment of FIG. 7, the outer surfaces of each individual shipped item 510 is suspended away from and out of contact with the inner surfaces of its respective single pack shipping container 700 by inflated cushions 104 and 102 or 106 such that it is at least partially cushioned and protected from external shocks and forces that may be applied to the outer surfaces of the shipping container 700 during shipment.

Figure 9:
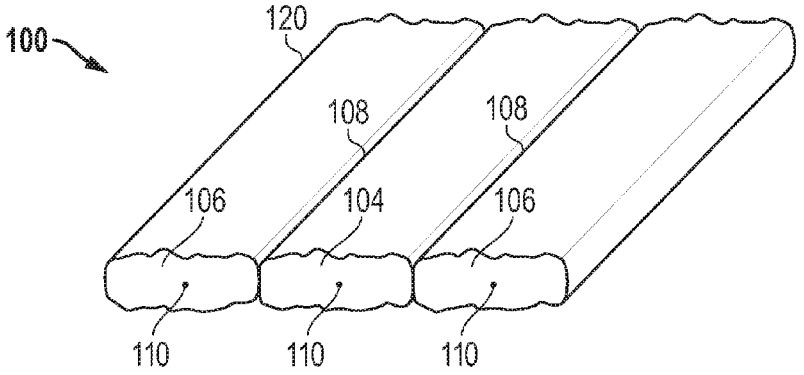
FIG. 9 illustrates an individual single pack shipping unit according to one exemplary embodiment of the disclosed systems and methods.

FIG. 9 illustrates an exemplary embodiment of an individual single pack shipping unit 120 as it may be separated and inflated into a second stage single pack configuration.

Figure 10:
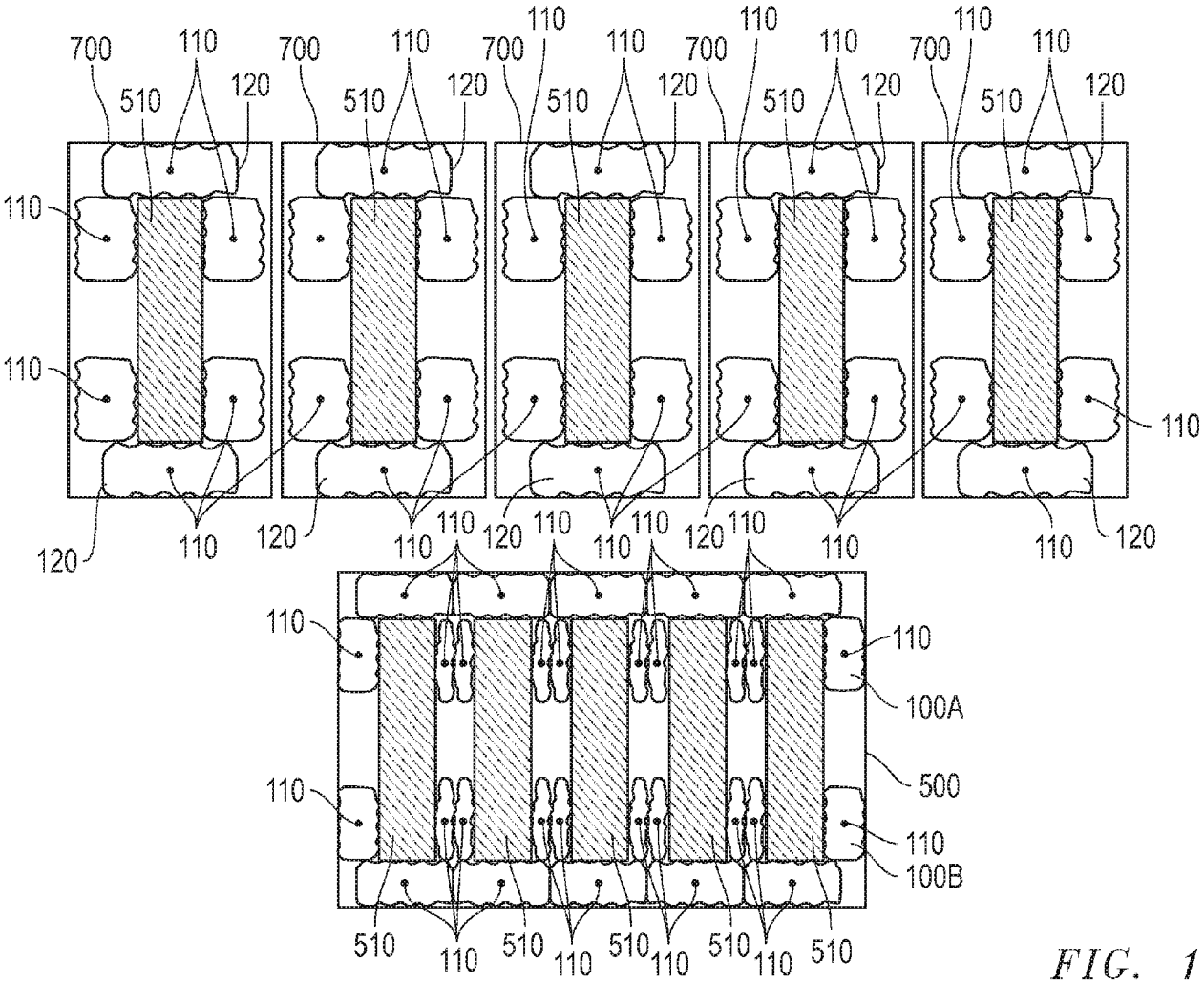
FIG. 10 illustrates first stage bulk packaging configuration and second stage single pack configuration according to one exemplary embodiment of the disclosed systems and methods.

FIG. 10 illustrates a side-by-side comparison of the dimensions (and therefore volume) required by the bulk packaging configuration of FIG. 5 for five shipped items 510 placed within bulk shipping container 500 versus the volume required by the single pack shipping configuration of FIG. 7 after separation and conversion of convertible multi-stage gas packaging systems 100A and 100B from first stage bulk packaging configuration to single pack shipping units 120 in second stage single pack shipping configuration. As may be seen, significantly less container length (and therefore volume) is occupied by the bulk packaging configuration of five shipped items 510 in bulk shipping container 500 than is occupied by the five individual separate single pack shipping containers 700 with shipped items 510 contained therein. Thus, significant shipping volume is saved during bulk shipping operations.

Figure 11:
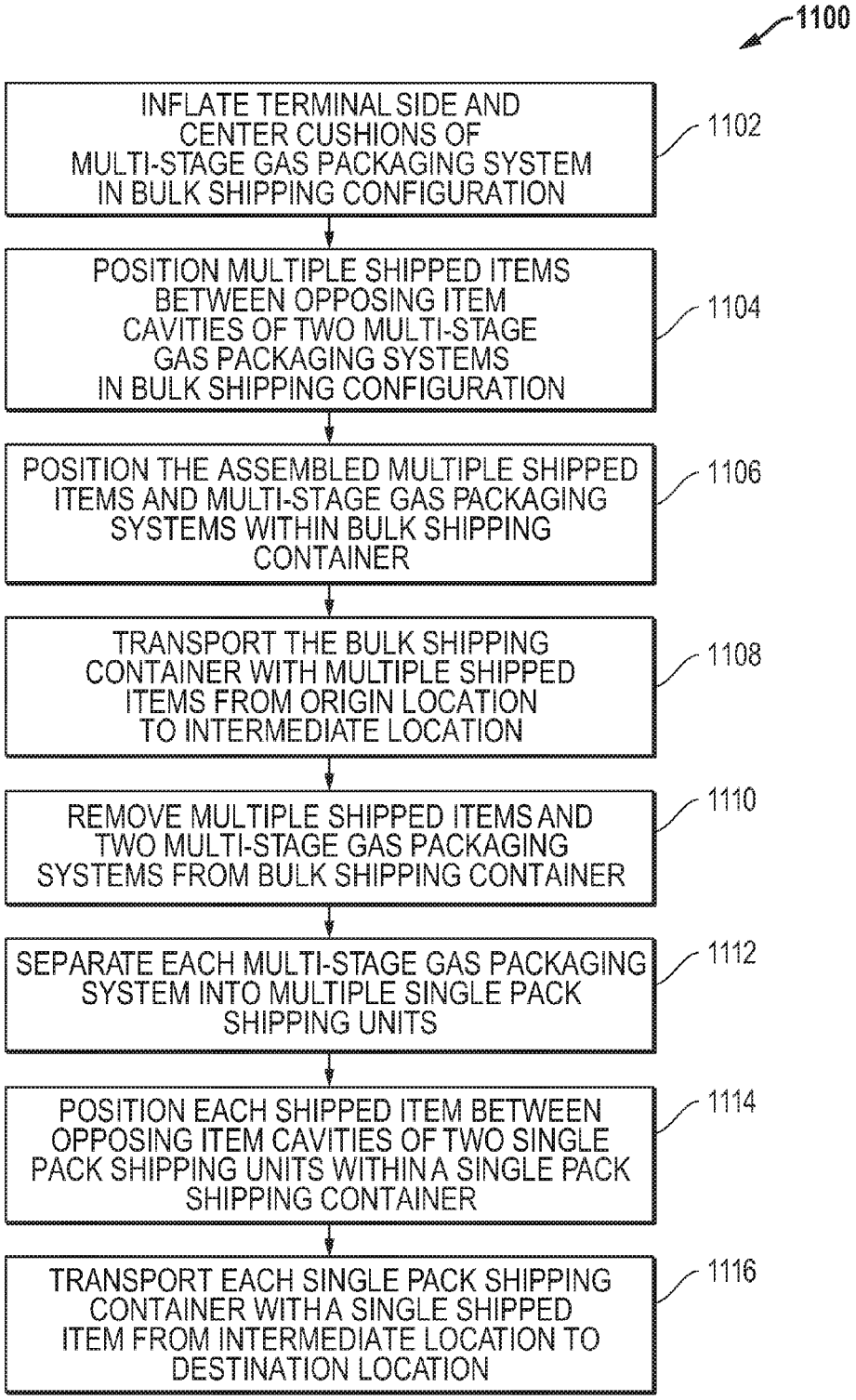
FIG. 11 illustrates a methodology for bulk shipping and single pack shipping according to one exemplary embodiment of the disclosed systems and methods.

FIG. 11 illustrates a methodology 1100 according to one exemplary embodiment of the disclosed systems and methods. In step 1102, terminal side cushions 102 and center cushions 104 of a multi-stage gas packaging system 100 in bulk shipping configuration are each inflated to suitable gas pressure. In step 1104, multiple shipped items 510 are positioned between opposing item cavities 190 of two multi stage gas packaging systems 100 that are in bulk shipping configuration. In step 1106, the multiple shipped items 510 are positioned together with the two gas packaging systems 100 within a bulk shipping container 500. In step 1108, the bulk shipping container 500 is transported with its contents (i.e., multiple shipped items 510 and two multi-stage gas packaging systems 100) from a first origin physical location to a second and different intermediate physical location. In step 1110, the multiple shipped items 510 and accompanying two gas packaging systems 100 are removed from the bulk shipping container 500 at the intermediate location. In step 1112, the side cushions of each multi-stage gas packaging system 100 are separated to form multiple single pack shipping units 120. In step 1114, each shipped item 510 is positioned between opposing item cavities 190 of two single pack shipping units 120 within a single pack shipping container 700. In step 1116, each single pack shipping container 700 is transported with its contents (i.e., an individual shipped item 510 and two single pack shipping units 120) from the second intermediate physical location to a third and different destination physical location. It will be understood that the steps of methodology 1100 are exemplary only and that fewer, additional and/or alternative steps may be employed.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A method for shipping an item, comprising:

providing multiple items to be shipped, each of the multiple items having opposing first and second ends;

providing a bulk shipping container;

providing a first multi-stage gas packaging system comprising multiple shipping units coupled together by separable links in a first stage bulk packaging configuration, and each of the multiple shipping units comprising multiple gas inflatable cushions that are at least partially inflated to define an item cavity therebetween that is configured with a shape and dimension complementary to the outer dimensions of the first end of an item to be shipped;

providing a second multi-stage gas packaging system comprising multiple shipping units coupled together by separable links in a first stage bulk packaging configuration, and each of the multiple shipping units comprising multiple gas inflatable cushions that are at least partially inflated to define an item cavity therebetween that is configured with a shape and dimension complementary to the outer dimensions of the first end of an item to be shipped; and positioning the shipped items and the first and second multi-stage gas packaging systems in relation to each other within the bulk shipping container such that each item cavity of the first multi-stage gas packaging system faces a corresponding item cavity of the second multi-stage gas packaging system with a first end of each shipped item disposed in an item cavity of the first multi-stage gas packaging system and with the opposing second end of each shipped item disposed in a corresponding item cavity of the second multi-stage gas packaging system.

2. The method of claim 1, wherein each shipping unit comprises an at least partially inflated gas inflatable center cushion coupled between two at least partially inflated gas inflatable side cushions.

3. The method of claim 1, further comprising providing a first portion of the gas inflatable cushions of each shipping unit in a more fully inflated higher gas pressure state within the bulk shipping container than the gas pressure inflation state of a second portion of the gas inflatable cushions of the same shipping unit within the bulk shipping container such that each of the gas inflatable cushions of the first and second multi-stage gas packaging systems that face the inner surface of the bulk shipping container are in a more fully inflated higher gas pressure state than the gas inflatable cushions of the first and second multi-stage gas packaging systems that do not face the inner surface of the bulk shipping container.

4. The method of claim 3, further comprising:

then bulk shipping the shipped items and the first and second multi-stage gas packaging systems within the bulk shipping container from a first physical location to a second physical location that is different from the first physical location;

receiving the bulk shipping container at the second physical location;

then removing the shipped items and the first and second multi-stage gas packaging systems from the bulk shipping container at the second physical location;

then separating each of the shipping units from each other at the separable links therebetween to form individual single pack shipping units, and further inflating the second portion of the gas inflatable cushions to a more fully inflated higher gas pressure state for single pack shipping; and positioning each shipped item together with first and second ones of the single pack shipping units in relation to each other within a single pack shipping container such that each item cavity of the first single pack shipping container faces a corresponding item cavity of the second single pack shipping container with a first end of each shipped item disposed in an item cavity of the first single pack shipping container and with the opposing second end of each shipped item disposed in a corresponding item cavity of the second single pack shipping container.

5. The method of claim 4, further comprising single pack shipping each of the shipped items together with first and second shipping units within the bulk shipping container from the second physical location to a third physical location that is different from the second physical location.

6. The method of claim 1, wherein each of the shipped items is an information handling system.

7. A multi-stage gas packaging system convertible between a first stage bulk packaging configuration and a second stage single pack configuration, comprising:

multiple shipping units coupled together by separable links in a first stage bulk packaging configuration, each of the multiple shipping units comprising multiple gas inflatable cushions that when at least partially inflated define an individual item cavity therebetween that is separate from an individual item cavity defined by the multiple gas inflatable cushions of each other of the multiple shipping units and that is configured with a shape and dimension complementary to the outer dimensions of the first end of an item to be shipped;

where the multi-stage gas packaging system is configured for conversion to a second stage single pack configuration by separating each of the shipping units from each other at the separable links therebetween to form individual single pack shipping units.

8. The system of claim 7, where each of the gas inflatable cushions comprise at least one gas valve feature through which gas may be introduced to inflate the respective cushion and which operates to retain the gas within the cushion after inflation.

9. The system of claim 7, where each given shipping unit comprises:

a gas inflatable center cushion having two opposing edges and being coupled between two separate gas inflatable side cushions, each given one of the two inflatable side cushions of the given shipping unit having opposing first and second side surfaces separated by an edge of the given inflatable side cushion;

where each of the two opposing edges of the center cushion of the given shipping unit are hingeably coupled to the respective edge of a separate one of the two gas inflatable side cushions of the given shipping unit;

where the first side surface of each of the two side cushions of the given shipping unit faces toward the item cavity of the given shipping unit and where the second side surface of each of the two side cushions of the given shipping unit faces away from the item cavity of the given shipping unit; and where the second side surface of at least one of the two side cushions of the given shipping unit is coupled in facing relationship to a second side surface of a side cushion of an adjacent shipping unit by one of the separable links.

10. The system of claim 7, where each of the multiple shipping units is configured to form the first stage bulk packaging configuration when a first portion of the gas inflatable cushions of each shipping unit are in a more fully inflated higher gas pressure state than the gas pressure inflation state of a second portion of the gas inflatable cushions of the same shipping unit; and where each of the multiple shipping units is configured to form the second stage single pack configuration when each of the second portion of the gas inflatable cushions is in a more fully inflated higher gas pressure state than the second portion of the gas inflatable cushions are in the first stage bulk packaging configuration.

11. A system for shipping, comprising:

first and second multi-stage gas packaging systems each of the first and second multi-stage gas packaging systems being convertible between a first stage bulk packaging configuration and a second stage single pack configuration, and comprising:

multiple shipping units coupled together by separable links in a first stage bulk packaging configuration, each of the multiple shipping units comprising multiple gas inflatable cushions that when at least partially inflated define an item cavity therebetween that is configured with a shape and dimension complementary to the outer dimensions of the first end of an item to be shipped, where the multi-stage gas packaging system is configured for conversion to a second stage single pack configuration by separating each of the shipping units from each other at the separable links therebetween to form individual single pack shipping units;

a bulk shipping container; and multiple items for shipping;

where the shipped items and the first and second multi-stage gas packaging systems are positioned in relation to each other within the bulk shipping container such that each item cavity of the first multi-stage gas packaging system faces a corresponding item cavity of the second multi-stage gas packaging system with a first end of each shipped item disposed in an item cavity of the first multi-stage gas packaging system and with the opposing second end of each shipped item disposed in a corresponding item cavity of the second multi-stage gas packaging system.

12. A method for shipping an item, comprising:

providing multiple items to be shipped, each of the multiple items having opposing first and second ends;

providing a bulk shipping container;

providing a first multi-stage gas packaging system in a first stage bulk packaging configuration, the first multi-stage gas packaging system comprising:

multiple gas inflatable center cushions that are at least partially inflated and that are positioned adjacent to each other between opposing ends of the first multi-stage packaging system, and a gas inflatable intermediate or terminal side cushion that is at least partially inflated and that is connected to each of two opposing sides of each of the multiple gas inflatable center cushions of the first multi-stage packaging system, where a gas inflatable intermediate side cushion connected to each gas inflatable center gas cushion is also connected by a separable link to another gas inflatable intermediate side cushion connected to an adjacent gas inflatable center gas cushion to hold the multiple gas inflatable center cushions of the first multi-stage packaging system in adjacent position to each other, where a terminal gas inflatable side cushion not connected to another gas inflatable side cushion is connected to the gas inflatable center gas cushions present at each of the opposing ends of the first multi-stage packaging system, and where an item cavity configured with a shape and dimension complementary to the outer dimensions of the first end of an item to be shipped is defined between each given gas inflatable center cushion and the two gas inflatable side cushions connected to the given gas inflatable center cushion of the first multi-stage packaging system;

providing a second multi-stage gas packaging system in a first stage bulk packaging configuration, the second multi-stage gas packaging system comprising:

multiple gas inflatable center cushions that are at least partially inflated and that are positioned adjacent to each other between opposing ends of the second multi-stage packaging system, and a gas inflatable intermediate or terminal side cushion that is at least partially inflated and that is connected to each of two opposing sides of each of the multiple gas inflatable center cushions of the second multi-stage packaging system, where a gas inflatable intermediate side cushion connected to each gas inflatable center gas cushion is also connected by a separable link to another gas inflatable intermediate side cushion connected to an adjacent gas inflatable center gas cushion to hold the multiple gas inflatable center cushions of the second multi-stage packaging system in adjacent position to each other, where a terminal gas inflatable side cushion not connected to another gas inflatable side cushion is connected to the gas inflatable center gas cushions present at each of the opposing ends of the second multi-stage packaging system, and where an item cavity configured with a shape and dimension complementary to the outer dimensions of the second end of an item to be shipped is defined between each given gas inflatable center cushion and the two gas inflatable side cushions connected to the given gas inflatable center cushion of the second multi-stage packaging system;

providing each of the gas inflatable terminal side cushions and each of the gas inflatable center cushions of the first and second multi-stage gas packaging systems in a more fully inflated higher gas pressure state than each of the gas inflatable side cushions of the first and second multi-stage gas packaging systems; and positioning the shipped items and the first and second multi-stage gas packaging systems in relation to each other within the bulk shipping container such that each item cavity of the first multi-stage gas packaging system faces a corresponding item cavity of the second multi-stage gas packaging system with a first end of each shipped item disposed in an item cavity of the first multi-stage gas packaging system and with the opposing second end of each shipped item disposed in a corresponding item cavity of the second multi-stage gas packaging system.

13. The method of claim 12, further comprising in the first stage bulk packaging configuration providing each of the gas inflatable terminal side cushions and each of the gas inflatable center cushions in a substantially fully inflated state, and providing each of the gas inflatable intermediate side cushions in only a partially inflated state.

14. The method of claim 12, further comprising then bulk shipping the shipped items and the first and second multi-stage gas packaging systems within the bulk shipping container from a first physical location to a second physical location that is different from the first physical location.

15. The method of claim 14, further comprising:

receiving the bulk shipping container at the second physical location;

then removing the shipped items and the first and second multi-stage gas packaging systems from the bulk shipping container at the second physical location;

then converting each of the first and second multi-stage gas packaging systems to a second stage single pack configuration by:

separating each of the at least partially inflated intermediate side cushions from another of the at least partially inflated intermediate side cushions at the separable link therebetween to form a single pack shipping unit comprising an at least partially inflated gas inflatable center cushion coupled between two at least partially inflated gas inflatable side cushions with an item cavity defined therebetween, and further inflating each of the intermediate side cushions to a more fully inflated state for single pack shipping; and positioning each shipped item together with first and second ones of the single pack shipping units in relation to each other within a single pack shipping container such that each item cavity of the first single pack shipping container faces a corresponding item cavity of the second single pack shipping container with a first end of each shipped item disposed in an item cavity of the first single pack shipping container and with the opposing second end of each shipped item disposed in a corresponding item cavity of the second single pack shipping container.

16. The method of claim 15, further comprising single pack shipping each of the shipped items together with first and second shipping units within the bulk shipping container from the second physical location to a third physical location that is different from the second physical location.

17. The method of claim 12, further comprising in the second stage single pack configuration providing each of the gas inflatable terminal side cushions, each of the gas inflatable center cushions, and each of the gas inflatable intermediate side cushions in a substantially fully inflated state.

18. A multi-stage gas packaging system configured to be convertible between a first stage bulk packaging configuration and a second stage single pack configuration, comprising:

multiple gas inflatable center cushions positioned adjacent to each other between opposing ends of the multi-stage packaging system; and a gas inflatable intermediate or terminal side cushion connected to each of two opposing sides of each of the multiple gas inflatable center cushions of the multi-stage packaging system;

where the multi-stage gas packaging system is configurable to have the following characteristics in the first stage bulk packaging configuration:

the multiple gas inflatable center cushions are positioned adjacent to each other between opposing ends of the multi-stage packaging system, a gas inflatable intermediate side cushion connected to each gas inflatable center gas cushion is also connected by a separable link to another gas inflatable intermediate side cushion connected to an adjacent gas inflatable center gas cushion to hold the multiple gas inflatable center cushions of the multi-stage packaging system in adjacent position to each other, and a terminal gas inflatable side cushion not connected to another gas inflatable side cushion is connected to the gas inflatable center gas cushions present at each of the opposing ends of the multi-stage packaging system, where each given gas inflatable center cushion and the two gas inflatable side cushions connected to the given gas inflatable center cushion of the multi-stage packaging system are at least partially inflated to define an item cavity configured with a shape and dimension complementary to the outer dimensions of one end of an item to be shipped between each given at least partially inflated gas inflatable center cushion and the at least partially inflated two gas inflatable side cushions connected to the given gas inflatable center cushion of the multi-stage packaging system; and wherein the multi-stage gas packaging system is configured for conversion to the second stage single pack configuration by separating each of the intermediate side cushions from another of the intermediate side cushions at the separable link therebetween to form a single pack shipping unit comprising an at least partially inflated gas inflatable center cushion coupled between two at least partially inflated gas inflatable side cushions with an item cavity defined therebetween that has a shape and dimension complementary to the outer dimensions of one end of an item to be shipped.

19. The system of claim 18, where each of the gas inflatable side and center cushions comprise at least one gas valve feature through which gas may be introduced to inflate the respective cushion and which operates to retain the gas within the cushion after inflation.

20. The system of claim 18, where each gas inflatable intermediate or terminal side cushion is hingeably connected to one side of a gas inflatable center cushion of the multi-stage packaging system.

21. The system of claim 18, where in the first stage bulk packaging configuration each gas inflatable intermediate side cushion is connected by a separable link of perforated material to another adjacent gas inflatable intermediate side cushion.

22. The system of claim 18, where in the first stage bulk packaging configuration each of the gas inflatable terminal side cushions and each of the gas inflatable center cushions are inflated to a more fully inflated higher gas pressure state than each of the gas inflatable intermediate side cushions; and where in the second stage single pack configuration each of the gas inflatable intermediate side cushions is in a more fully inflated higher gas pressure state than it is when the multi-stage packaging system is in the first stage bulk packaging configuration.

23. The system of claim 18, where in the first stage bulk packaging configuration, each of the gas inflatable terminal side cushions and each of the gas inflatable center cushions are substantially fully inflated and each of the gas inflatable intermediate side cushions are only partially inflated; and where in the second stage single pack configuration each of the gas inflatable terminal side cushions, each of the gas inflatable center cushions, and each of the gas inflatable intermediate side cushions are substantially full inflated.

24. A system for shipping, comprising first and second multi-stage gas packaging systems of claim 18 that are configured in the first stage bulk packaging configuration, a bulk shipping container, and multiple items for shipping; where the shipped items and the first and second multi-stage gas packaging systems are positioned in relation to each other within the bulk shipping container such that each item cavity of the first multi-stage gas packaging system faces a corresponding item cavity of the second multi-stage gas packaging system with a first end of each shipped item disposed in an item cavity of the first multi-stage gas packaging system and with the opposing second end of each shipped item disposed in a corresponding item cavity of the second multi-stage gas packaging system.

25. A multi-stage gas packaging system convertible between a first stage bulk packaging configuration and a second stage single pack configuration, comprising:

multiple shipping units coupled together by separable links in a first stage bulk packaging configuration, each of the multiple shipping units comprising multiple gas inflatable cushions that are at least partially inflated and defining an individual item cavity therebetween that is separate from an individual item cavity defined by multiple at least partially inflated gas inflatable cushions of each other of the multiple shipping units and that is configured with a shape and dimension complementary to the outer dimensions of the first end of an item to be shipped;

where the multi-stage gas packaging system is configured for conversion to a second stage single pack configuration by separating each of the shipping units from each other at the separable links therebetween to form individual single pack shipping units.

* * * * *